US005852761A

United States Patent [19]

Marcelletti et al.

[11] Patent Number: 5,852,761

[45] Date of Patent: Dec. 22, 1998

[54] MOTORIZED WICK FOR FUSING APPARATUS

[75] Inventors: John Marcelletti, Rochester; John C. Fournier, Jr., Depew; James A. Micket, Webster, all of N.Y.

[73] Assignee: Eastman Kodak Company, Rochester, N.Y.

[21] Appl. No.: 903,618

[22] Filed: Jul. 31, 1997

[51] Int. Cl.[6] ..... G03G 15/20

[52] U.S. Cl. ..... 399/325; 399/324; 399/326

[58] Field of Search ..... 399/324, 325, 399/326

[56] References Cited

U.S. PATENT DOCUMENTS 5,049,944 9/1991 DeBolt et al. ..... 355/284
5,592,275 1/1997 Echigo et al. ..... 399/325
5,708,919 1/1998 Yamada et al. ..... 399/67

*Primary Examiner*—Richard Moses
*Assistant Examiner*—Shival Virmani
*Attorney, Agent, or Firm*—Milton S. Sales

[57] ABSTRACT

A fuser for fixing a toner image to a receiver sheet includes a housing, a fusing roller mounted for rotation within the housing, and a rotatable wick for applying offset-preventing liquid to the fusing roller. The rotatable wick is adjustable between a first position in frictional contact with the fusing roller, wherein the rotatable wick is rotated by the fusing roller and applies an amount of offset-preventing liquid to the fusing roller, and a second position spaced from the fusing roller. An actuation structure selectively moves the rotatable wick between its first and second positions. A motor and a transmission interconnecting the motor and the rotatable wick, at least when the rotatable wick is in its second position, are provided to effect rotation of the rotatable wick to inhibit settlement of offset-preventing liquid in the rotatable wick.

11 Claims, 7 Drawing Sheets

MOTORIZED WICK FOR FUSING APPARATUS

FIELD OF THE INVENTION

This invention relates to image-forming apparatus having a toner image fuser. More particularly, it relates to such an apparatus in which a fusing roller requires oiling such as by a rotating wick.

BACKGROUND OF THE INVENTION

Application of fusing oil to the fusing roller in prior structures has been accomplished with a variety of mechanisms. For example, oil can be applied by a stationary wick which has one end in a reservoir and the other end contacting the fusing roller. The wick can be made movable for control of oil application. Another common structure includes an articulatable roller to which oil is applied by an external wick.

U.S. Pat. No. 4,429,990, granted to E. J. Tamary Feb. 7, 1984, discloses a wicking structure in which oil is transported under pressure from a container to a permanent internal feed tube located inside a replaceable porous applicating wick. At least the outside portion of the wick is rotatable by the roller being oiled. For other examples of rotating wicks, see U.S. Pat. Nos. 4,908,670; 5,043,768; and 3,964,431.

It is possible to control the amount of oil applied by controlling a pump that feeds oil to the system. However, in most wicking devices, the rotating wick is articulatable into and out of contact with either the surface being oiled or an intermediate surface further upstream of the surface being oiled.

Rotating wicks require rotation to keep the oil contained inside the wick evenly distributed throughout its porous ceramic core and its aramid felt cover. Should the wick be left in one position for a long period of time during an idle mode, the oil will tend to settle into the lowest part of the wick. At start-up, this could cause heavy bands of oil, corresponding to the saturated portion of the wick, to be applied to the fusing roller.

DISCLOSURE OF THE INVENTION

It is an object of the present invention to provide for application of oil from a rotating wick, while inhibiting the settling of oil during idle modes.

According to a feature of the present invention, a fuser for fixing a toner image to a receiver sheet includes a housing, a fusing roller mounted for rotation within the housing, and a rotatable wick for applying offset-preventing liquid to the fusing roller. The rotatable wick is adjustable between a first position in frictional contact with the fusing roller, wherein the rotatable wick is rotated by the fusing roller and applies an amount of offset-preventing liquid to the fusing roller, and a second position spaced from the fusing roller. An actuation structure selectively moves the rotatable wick between its first and second positions. A motor and a transmission interconnecting the motor and the rotatable wick, at least when the rotatable wick is in its second position, are provided to effect rotation of the rotatable wick to inhibit settlement of offset-preventing liquid in the rotatable wick.

According to another feature of the present invention, a process for fixing a toner image to a receiver sheet with a fusing roller and a rotatable wick for applying offset-preventing liquid to the fusing roller includes the steps of selectively moving the rotatable wick between a first position in frictional contact with the fusing roller, wherein the rotatable wick is rotated by the fusing roller and applies an amount of offset-preventing liquid to the fusing roller, and a second position spaced from the fusing roller. A motor is interconnected to the rotatable wick at least when the rotatable wick is in its second position to effect rotation of the rotatable wick to inhibit settlement of offset-preventing liquid in the rotatable wick.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art. While the invention is described below in the environment of an electrographic imaging system, it will be noted that the invention can be used with other types of apparatus which requires the application of a fluid from a rotating wick.

Figure 1:
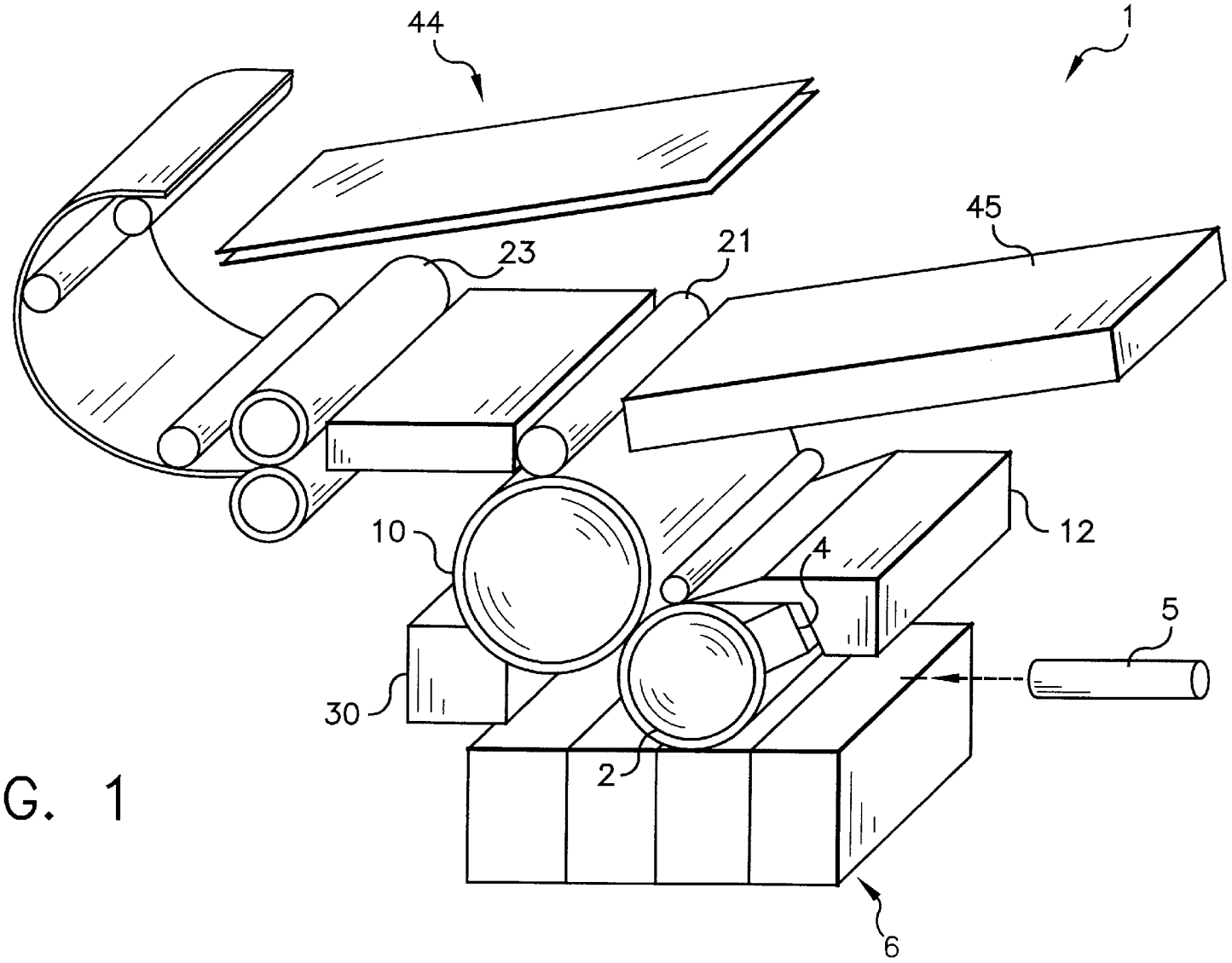
FIG. 1 is a perspective schematic of an image-forming apparatus showing essential stations without housing and other support structure.

According to FIG. 1, an image-forming apparatus, for example a color printer 1, includes a photoconductive drum 2 and a transfer drum 10. Transfer drum 10 is rotated by suitable means, not shown, and drives photoconductive drum 2 by way of frictional engagement with it. This aspect of printer 1 is more thoroughly explained in U.S. Pat. No. 5,087,939 to D. R. McDougal.

The periphery of photoconductive drum 2 is moved past a charging station 4 and an exposure station, having an imager such as a laser 5, to form a series of electrostatic images on the periphery utilizing conventional electrophotography. Each of the series of electrostatic images is toned by one or more of the four toner stations in a development device 6. Each development station contains a different color toner. Development device 6 is indexed through operative relationship with drum 2 to apply different color toners to each of the images in the series of electrostatic images. The toner images so formed are transferred, in registration, to the periphery of a transfer drum 10 under the influence of an electric field applied between the two drums to create a multicolor image on drum 10. Drum 2 is continuously cleaned by a cleaning device 12 and drum 10 is periodically cleaned by a cleaning device 30.

Receiving sheets are fed from a receiving sheet supply 45 into a nip formed between a transfer roller 21 and transfer drum 10. An electrostatic field applied between transfer drum 10 and roller 21 transfers the multicolor image to the receiving sheet. The receiving sheet is transported, for example, by drum 10 and roller 21, to a fuser 23 where the multicolor image is fixed to it and then transported to an output hopper 44.

Figure 2:
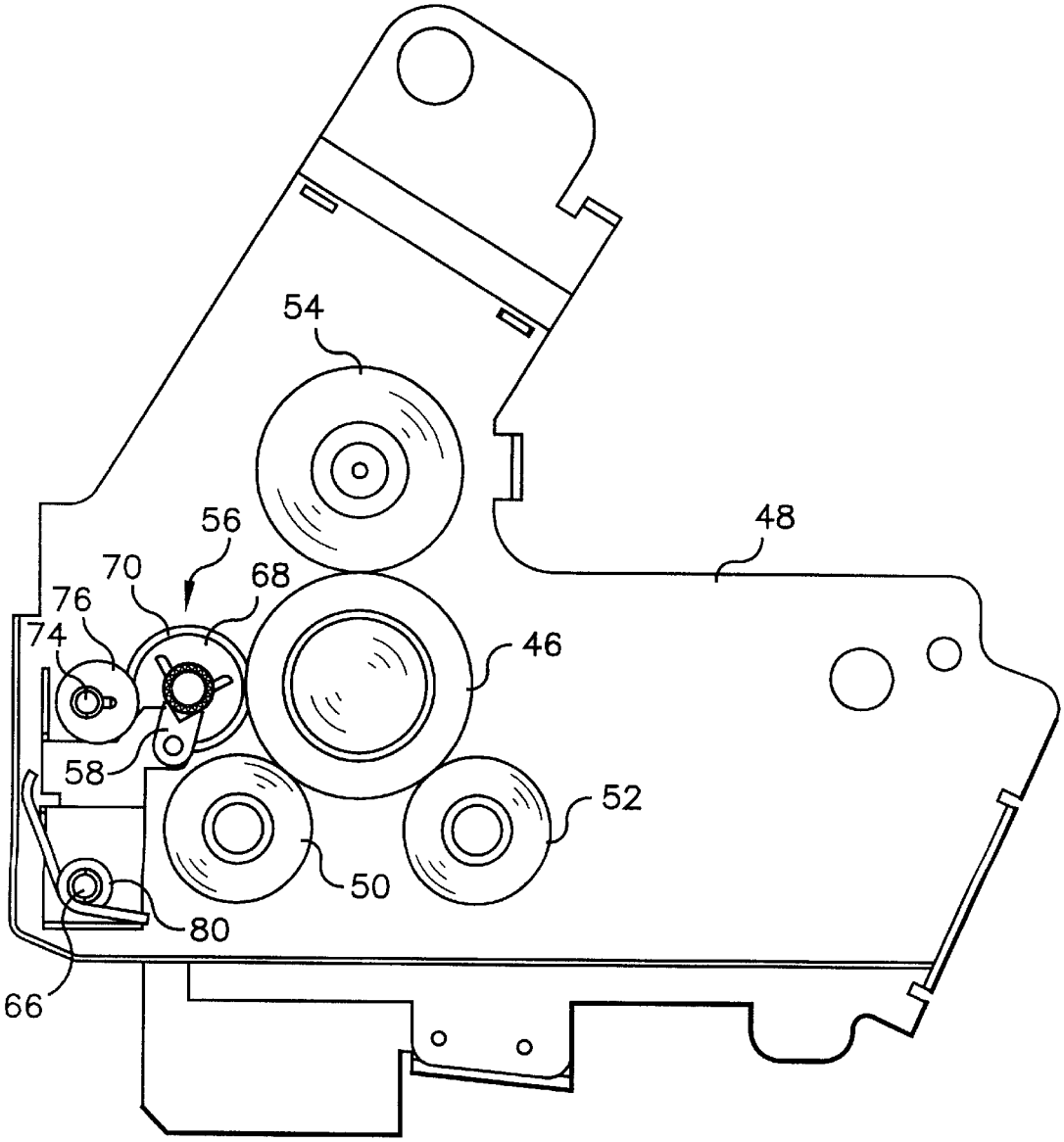
FIG. 2 is an end view of a fusing apparatus according to the present invention.
Figure 3:
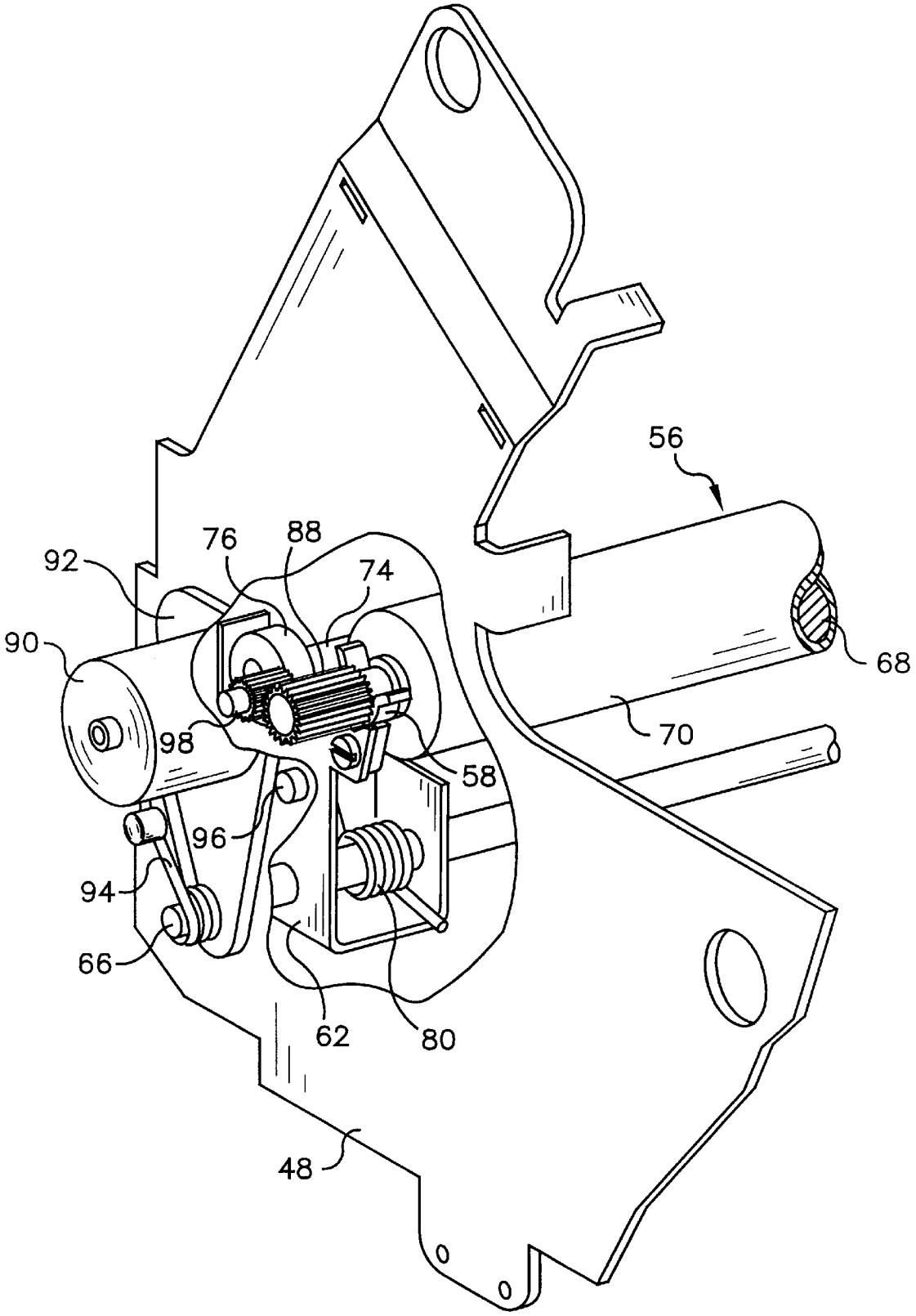
FIG. 3 is a perspective view of the fusing apparatus of FIG. 2.
Figure 4:
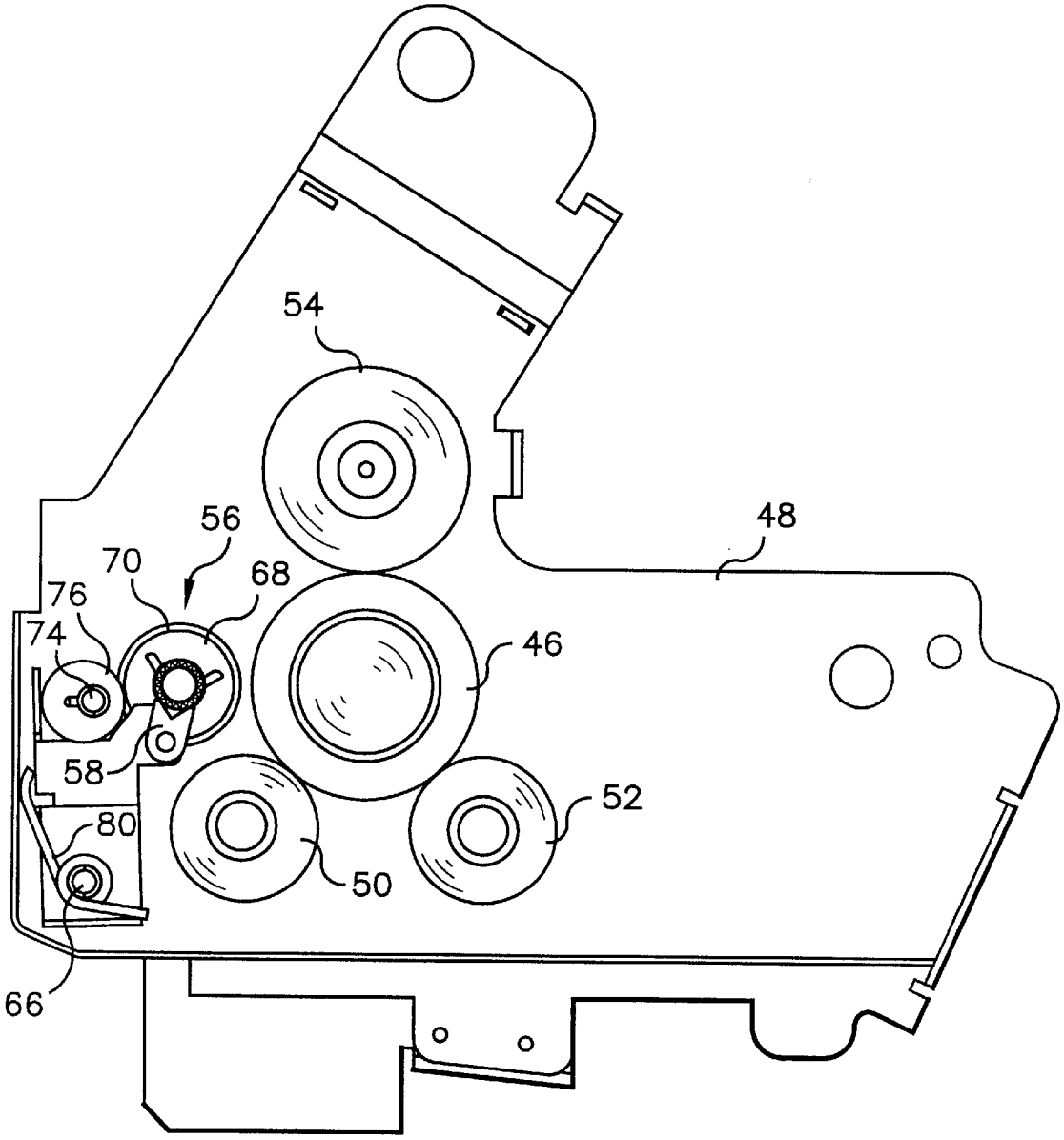
FIG. 4 is an end view of the fusing apparatus of FIG. 2 in another stage of operation.

Referring to FIGS. 2–4, a fusing roller 46 is supported and journalled for rotation on a pair of mechanism plates. One 48 of the plates is illustrated in FIGS. 2–4. A pair of heater rollers 50 and 52 transfer fusing heat to roller 46, although heat may be applied by means of a radiant lamp or an internal heater. A pressure roller 54 forms a fusing nip with fusing roller 46.

Figure 7:
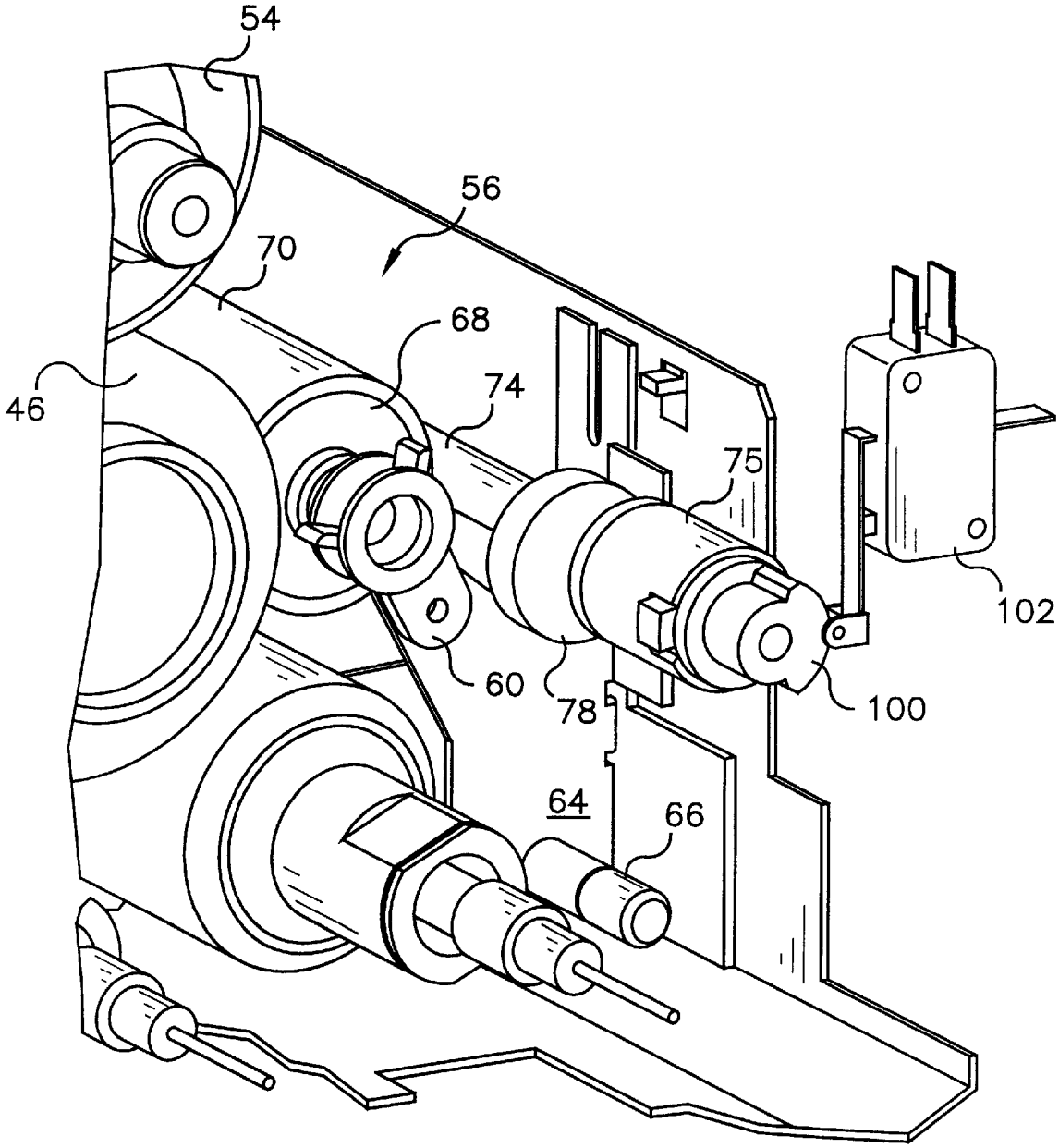
FIG. 7 is a perspective view of the fusing apparatus of FIG. 2 taken from another viewing angle.

A rotatable wick 56 is journalled at each end in yokes 58 and 60 (yoke 60 is shown in FIG. 7) on a pair of armatures 62 and 64, respectively, for rotation by frictional contact with fusing roller 46. Armatures 62 and 64 are articulatable about a shaft 66 to apply offset-preventing liquid (fusing oil) to fusing roller 46. Oil is supplied to wick 56 through a liquid transport tube, not shown, which runs from a supply position at one end of a distribution tube internal to wick 56. The wick includes a porous ceramic core 68 wrapped with a conventional wicking material cover 70. One wrap is usual, although more wraps could be used.

Referring to FIG. 7, a DC electric gear motor 72 can be actuated to drive a cam shaft 74 through a drive coupling 75. Shaft 74 carries a pair of wick cams 76 (FIGS. 2 and 3) and 78. When the cams are positioned as illustrated in FIGS. 2 and 3, a pair of springs 80 (FIGS. 2 and 3) and 82 load armatures 62 and 64 so as to pivot in a clockwise direction as shown in FIGS. 2–5 to carry rotatable wick 56 towards and against fusing roller 46. Cams 76 and 78 are spaced from a respective pair of cam follower arms 84 and 86 so that springs 80 and 82 can hold the wick against the fusing roller. When the wick is engaged on the fusing roller, the rotation of the fusing roller, along with the friction between the roller and the wick, causes the wick to rotate. At the conclusion of a fusing cycle, the gear motor 72 is again energized to rotate cam shaft 74 and cams 76 and 78, in turn driving armatures 62 and 64 away from the fusing roller against the force of springs 80 and 82. This retracts the wick and stops the oiling of the fusing roller.

According to a feature of the present invention, apparatus has been provided to rotate wick 56 when it is not in contact with fusing roller 46. This apparatus is adapted to disengage when the wick is being driven by the fusing roller.

A gear 88 is provided on an end plug of the shaft of the wick. An electric motor 90 is mounted on a pivot plate 92, which in turn is pivotally mounted on mechanism plate 48. A pivot spring 94 is mounted to the mechanism plate to load the pivot plate against the pivot stop 96. Motor 90 has a pinion gear 98 pressed onto its output shaft with the appropriate pitch to mate with wick end plug gear 88.

During the running mode, wick 56 is against fusing roller 46 and is rotating due to the friction between the wick and the fusing roller (FIGS. 2 and 3). Pivot plate 92 is rotated against pivot stop 96 and is held there by the force applied by pivot spring 94. Pinion gear 98 is not engaged with gear 88 of the wick.

At the conclusion of an oiling operation, the wick is retracted away from fusing roller 46. As the wick is being retracted, it stops rotating and its gear 88 begins to mesh with pinion gear 98 of the wick drive motor. As the wick continues to retract, it begins to push on the pinion gear, causing pivot plate 92 to rotate against the force of spring 94. The motor is mounted on a spring loaded pivot plate to ensure that the pinion gear of the motor is always engaged properly with the gear of the wick end plug. This movement of the wick drive motor eliminates the slop that would result from tolerance build-up and wear of components.

Figure 5:
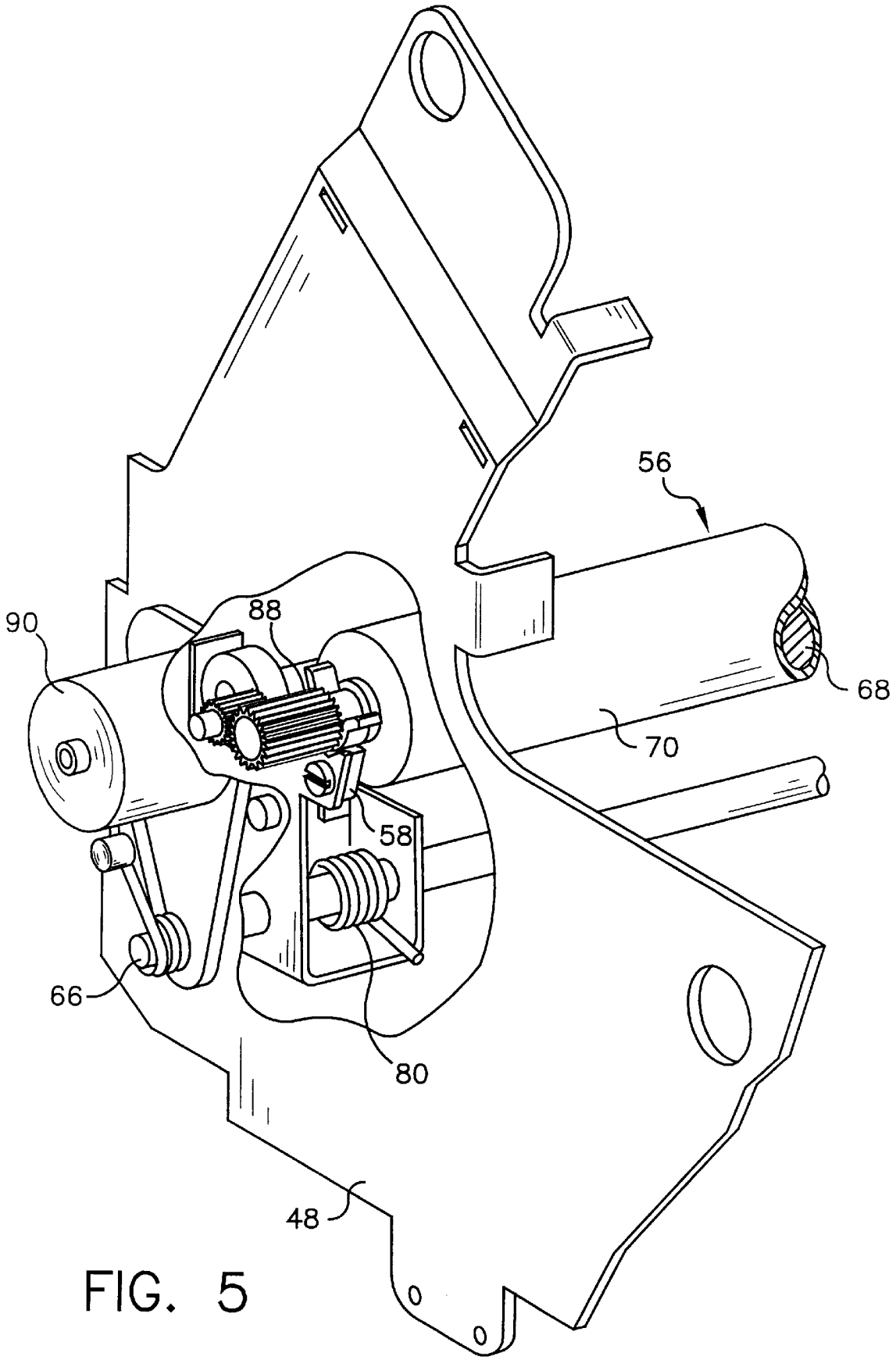
FIG. 5 is a perspective view of the fusing apparatus of FIG. 3.
Figure 6:
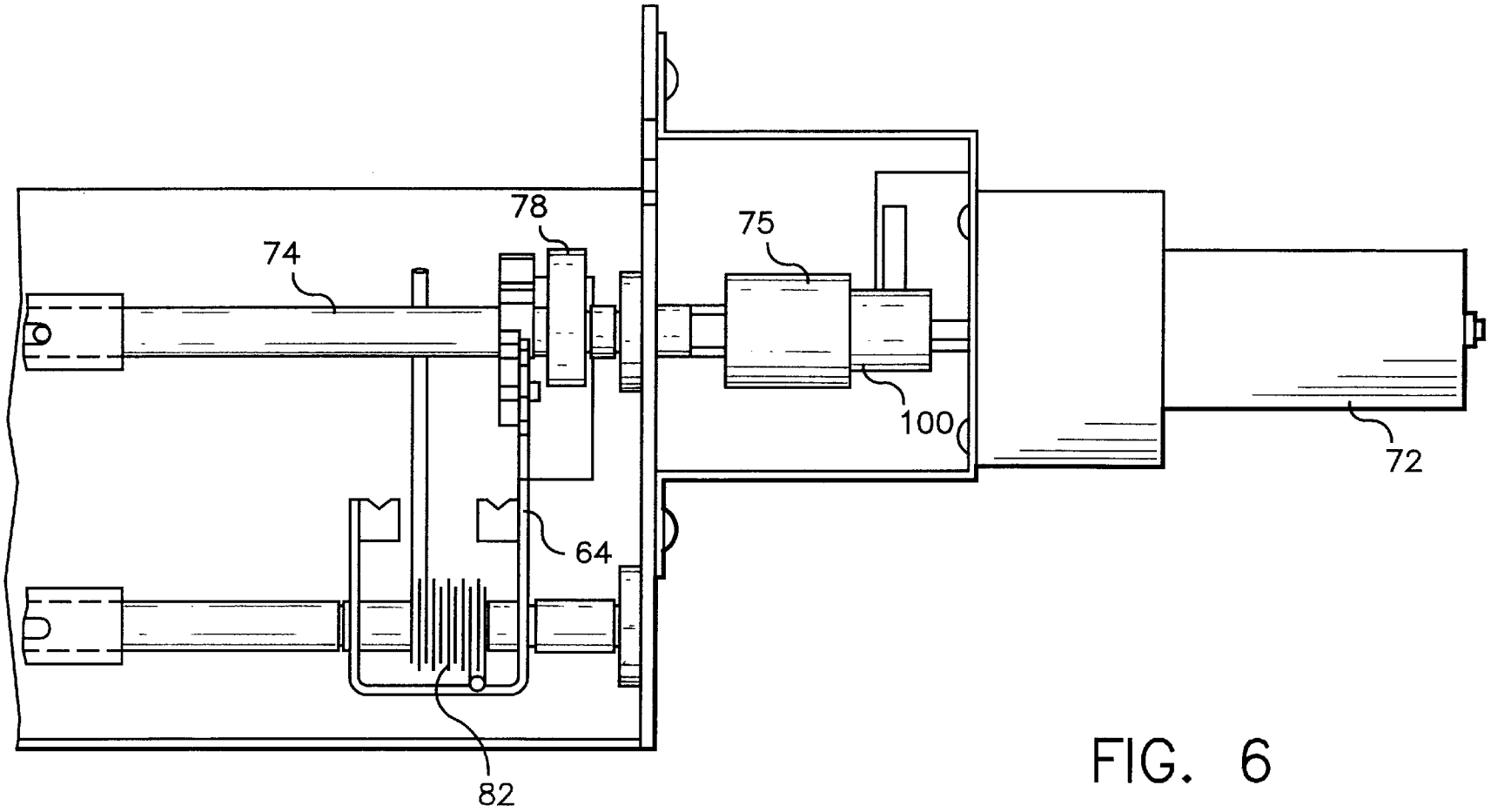
FIG. 6 is a top view of another portion of the fusing apparatus of FIG. 2.

As cam shaft 74 rotates from its FIGS. 2 and 3 position to its FIGS. 4 and 5 position to withdraw the wick from the fusing roller, a cam lobe 100, shown in FIG. 7, presses against the arm of a normally closed wick position electrical switch 102. When the wick reaches its final home position, the wick position electrical switch is open to energize motor 90. This motor rotates the wick slowly, keeping the oil inside the wick evenly distributed within. This motor continues to rotate until the beginning of the next oiling cycle. It will preferably continue to rotate when the main power switch on the machine is turned off.

The invention has been described in detail with particular reference to preferred embodiments thereof, but it will be understood that variations and modifications can be effected within the spirit and scope of the invention.

What is claimed is:

1. A fuser for fixing a toner image to a receiver sheet, said fuser including:

a housing;

a fusing roller mounted for rotation within said housing;

a rotatable wick for applying offset-preventing liquid to the fusing roller, said rotatable wick being adjustable between a first position in frictional contact with the fusing roller, wherein the rotatable wick is rotated by the fusing roller and applies an amount of offset-preventing liquid to the fusing roller, and a second position spaced from the fusing roller;

actuation structure for selectively moving the rotatable wick between its first and second positions;

a motor; and a transmission interconnecting the motor and the rotatable wick at least when the rotatable wick is in its second position to effect rotation of the rotatable wick to inhibit settlement of offset-preventing liquid in the rotatable wick.

2. A fuser as set forth in claim 1 wherein said actuation structure includes a cam and follower for moving the rotatable wick between its first and second positions.

3. A fuser as set forth in claim 2 wherein said actuation structure includes a cam and follower for moving the rotatable wick from its first position to its second position.

4. A fuser as set forth in claim 1 wherein said actuation structure includes a spring for urging the rotatable wick from its second position to its first position.

5. A fuser as set forth in claim 1 wherein said transmission interconnecting the motor and the rotatable wick at least when the rotatable wick is in its second position includes:

an electrical switch which has a first state transmitting power to the motor and a second state interrupting power to the motor; and a switch actuation device for setting the electrical switch to its second state when the rotatable wick is in its first position and for setting the electrical switch to its first state to effect rotation of the rotatable wick to inhibit settlement of offset-preventing liquid in the rotatable wick when the rotatable wick is in its second position.

6. A fuser as set forth in claim 1 wherein said transmission interconnecting the motor and the rotatable wick at least when the rotatable wick is in its second position includes a pair of gears, one of the gears being drivingly connected to the motor and the other of the gears being drivingly connected to the rotatable wick; said gears being not meshed when the rotatable wick is in its first position, and meshed when the rotatable wick is in its second position.

7. A fuser as set forth in claim 1 wherein said motor is carried on a movable armature, and said transmission interconnecting the motor and the rotatable wick at least when the rotatable wick is in its second position includes:

a pair of gears, one of the gears being drivingly connected to the motor and the other of the gears being drivingly connected to the rotatable wick;

a spring for urging the movable armature in a direction to mesh the pair of gears; and an abutment against which the armature is stopped short of having the gears mesh when the rotatable wick is in its first position, but which allows meshing of the gears as the rotatable wick moves from its first position to its second position.

8. A fuser as set forth in claim 7 wherein said movable armature is adapted to move away from the stop against the force of the spring as the rotatable wick approaches its second position.

9. A process for fixing a toner image to a receiver sheet with a fusing roller and a rotatable wick for applying offset-preventing liquid to the fusing roller, said process comprising:

selectively moving the rotatable wick between a first position in frictional contact with the fusing roller, wherein the rotatable wick is rotated by the fusing roller and applies an amount of offset-preventing liquid to the fusing roller, and a second position spaced from the fusing roller; and interconnecting a motor and the rotatable wick at least when the rotatable wick is in its second position to effect rotation of the rotatable wick to inhibit settlement of offset-preventing liquid in the rotatable wick.

10. A process as set forth in claim 9 wherein said interconnecting step includes:

transmitting power to the motor to effect rotation of the rotatable wick to thereby inhibit settlement of offset-preventing liquid in the rotatable wick when the rotatable wick is in its second position; and interrupting power to the motor when the rotatable wick is in its first position.

11. A process as set forth in claim 9 wherein said interconnecting step includes:

providing a pair of gears, one of the gears being drivingly connected to the motor and the other of the gears being drivingly connected to the rotatable wick; and meshing said gears when the rotatable wick is in its second position but not when the rotatable wick is in its first position.

* * * * *